US008061456B2

(12) United States Patent
Patel et al.

(10) Patent No.: US 8,061,456 B2
(45) Date of Patent: Nov. 22, 2011

(54) CHAMFERED EDGE GAGE CUTTERS AND DRILL BITS SO EQUIPPED

(75) Inventors: Suresh G. Patel, The Woodlands, TX (US); Danny E. Scott, Montgomery, TX (US); L. Allen Sinor, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 145 days.

(21) Appl. No.: 12/198,246

(22) Filed: Aug. 26, 2008

(65) Prior Publication Data

US 2009/0057031 A1 Mar. 5, 2009

Related U.S. Application Data

(60) Provisional application No. 60/968,239, filed on Aug. 27, 2007.

(51) Int. Cl.
*E21B 10/52* (2006.01)

(52) U.S. Cl. ..... 175/430

(58) Field of Classification Search ..... 175/430
See application file for complete search history.

(56) References Cited

U.S. PATENT DOCUMENTS

| | | | | |
|---|---|---|---|---|
| 5,287,936 | A * | 2/1994 | Grimes et al. | 175/331 |
| 5,346,026 | A * | 9/1994 | Pessier et al. | 175/331 |
| 5,437,343 | A * | 8/1995 | Cooley et al. | 175/431 |
| 5,447,208 | A * | 9/1995 | Lund et al. | 175/428 |
| 5,467,836 | A * | 11/1995 | Grimes et al. | 175/401 |
| 5,740,874 | A * | 4/1998 | Matthias | 175/430 |
| 5,881,830 | A * | 3/1999 | Cooley | 175/428 |
| 5,967,250 | A * | 10/1999 | Lund et al. | 175/428 |
| 6,006,846 | A | 12/1999 | Tibbitts et al. | |
| 6,050,354 | A * | 4/2000 | Pessier et al. | 175/430 |
| 6,053,263 | A * | 4/2000 | Meiners | 175/331 |
| 6,202,770 | B1 * | 3/2001 | Jurewicz et al. | 175/428 |
| 6,604,588 | B2 * | 8/2003 | Eyre et al. | 175/374 |
| 6,672,406 | B2 * | 1/2004 | Beuershausen | 175/57 |
| 6,904,984 | B1 * | 6/2005 | Estes et al. | 175/430 |
| 6,935,444 | B2 * | 8/2005 | Lund et al. | 175/426 |
| 7,188,692 | B2 * | 3/2007 | Lund et al. | 175/426 |
| 7,475,744 | B2 * | 1/2009 | Pope | 175/430 |

(Continued)

FOREIGN PATENT DOCUMENTS

WO WO 2009029649 A2 * 3/2009

OTHER PUBLICATIONS

"chamfer", http://www.thefreedictionary.com/p/chamfer, dated 2011, 2 pages.*

(Continued)

*Primary Examiner* — Jennifer H Gay
(74) *Attorney, Agent, or Firm* — TraskBritt

(57) ABSTRACT

A cutting element for an earth boring bit, may include a PDC layer having a flat on a periphery thereof, the flat terminating longitudinally at an edge spaced from a cutting face of the PDC layer. A chamfer adjacent to the cutting face desirably has a length that exceeds its depth. A cutting element may additionally include a chamfer along the entire circumference, multiple step-wise, radially adjacent chamfers, and multiple circumferentially spaced portions of the uppermost radius of the PDC layer of the cutting element that each includes a chamfer with an associated flat. Additionally, a cutting element may include a flat terminating at a radial edge with the cutting face of a PDC layer.

17 Claims, 3 Drawing Sheets

U.S. PATENT DOCUMENTS

| | | | | |
|---|---|---|---|---|
| 7,681,673 | B2 * | 3/2010 | Kolachalam | 175/430 |
| 7,690,442 | B2 * | 4/2010 | Portwood et al. | 175/57 |
| 7,726,420 | B2 * | 6/2010 | Shen et al. | 175/430 |
| 7,814,998 | B2 * | 10/2010 | Patel et al. | 175/432 |
| 2004/0163854 | A1 * | 8/2004 | Lund et al. | 175/431 |
| 2005/0247492 | A1 * | 11/2005 | Shen et al. | 175/426 |
| 2006/0157286 | A1 * | 7/2006 | Pope | 175/374 |
| 2007/0084640 | A1 | 4/2007 | Singh | |
| 2007/0131458 | A1 | 6/2007 | Shen et al. | |
| 2008/0164071 | A1 * | 7/2008 | Patel et al. | 175/431 |
| 2008/0308320 | A1 * | 12/2008 | Kolachalam | 175/331 |
| 2009/0057031 | A1 * | 3/2009 | Patel et al. | 175/420.2 |
| 2009/0272583 | A1 * | 11/2009 | Pope | 175/430 |
| 2010/0059287 | A1 * | 3/2010 | Durairajan et al. | 175/420.2 |
| 2011/0031030 | A1 * | 2/2011 | Shen et al. | 175/428 |

OTHER PUBLICATIONS

"bevel", http://www.answers.com/topic/bevel, dated 2011, 6 pages.*

International Search Report for International Application No. PCT/US2008/074433 dated Mar. 30, 2010, 3 pages.

International Written Opinion for International Application No. PCT/US2008/074433 dated Mar. 30, 2010, 5 pages.

* cited by examiner

CHAMFERED EDGE GAGE CUTTERS AND DRILL BITS SO EQUIPPED

CROSS-REFERENCE TO RELATED APPLICATION

This application claims the benefit of the filing date of U.S. Provisional Patent Application Ser. No. 60/968,239, filed Aug. 27, 2007, for "CHAMFERED EDGE GAGE CUTTER," the disclosure of which is hereby incorporated herein in its entirety by this reference.

TECHNICAL FIELD

Embodiments of the present invention relate to inserts in the form of cutting elements for earth boring drill bits, and to bits so equipped. More specifically, the cutting element comprises a flattened portion, or "flat," in combination with a chamfered portion on the cutting face in various embodiments. Such cutting elements have particular applicability for use on the gage of an earth boring drill bit.

BACKGROUND

FIG. 1 illustrates a perspective view of a portion of a prior art earth boring drill bit 8. Here, a cutting element 12 is shown disposed within a pocket of a blade 10. Cutting element 12 is a gage cutter, which is conventionally fabricated as a polycrystalline diamond compact (PDC) cutting element, which cutting element may also be characterized as a polycrystalline diamond cutter (PCD), the structure of which includes a polycrystalline diamond layer 14 on the end face of a carbide body, commonly termed a substrate. As is known, gage cutters are generally disposed along the outermost radial portion, or gage, of the drill bit 8. For dimensional and tolerance purposes, the uppermost cutting surface of the cutting element 12 (as the cutting element 12 is mounted on the drill bit 8, and with respect to the adjacent surface of the drill bit 8) is ground down so the bit diameter is within a specified value to drill a particular size of borehole. The grinding process produces a curved surface, known in the industry as a flat 18. The leading edge of the flat is typically a straight line, and the relatively sharp edge is known to produce high stress concentrations in that area of the PDC layer 14 when formation material is being cut.

A chamfer, indicated by reference numeral 16 in FIG. 1, is typically formed on a portion of the outer edge of the PDC layer 14 of PDC cutting elements. Chamfers generally comprise an angled section, conventionally at a 45° angle to the cutting face of PDC layer 14, on a portion of the front outer radius of the PDC layer. The chamfers are added to the cutting elements to reduce localized stresses on the PDC layer 14 when a cutting element is first cutting formation material. Thus, the inclusion of the chamfer on a cutting element used on the face of a drill bit can help prevent chipping and spalling along this portion of the PDC layer. However, the dimension of the chamfer 16 is small enough so that the forming of the flat 18 when a cutting element 12 is configured as a gage cutter causes the flat to extend radially inwardly on the front portion or cutting face of the PDC layer of the cutting element beyond the inner boundary of the so-called "chamfer envelope" of the PDC layer 14 and thus produces an interface 20 along the boundary where the flat 18 meets with the front portion of the PDC layer 14. The interface 20 has a sharp edge that often experiences high localized stresses during drilling, resulting in development of a damaged portion 21 along this interface 20. Examples of the damaged portion 21 include chips and cracks in the PDC material, and even spallings of masses of PDC material from the PDC layer 14.

BRIEF SUMMARY

Embodiments of the present disclosure comprise cutting elements, which may also be termed inserts, having a flat on a periphery of a PDC layer thereof and terminating longitudinally at an edge spaced from a cutting face of the PDC layer. The edge of the flat may lie outside a radially or laterally inner boundary of an envelope, or radial extent, of a chamfer at the peripheral edge of the cutting face.

In one embodiment, the chamfered portion has a width, measured radially, that exceeds its depth, as measured along the cutting element axis. In another embodiment, the flat extends along a finite portion of the circumference of the insert, whereas the chamfer extends around the entire circumference of the insert.

Other embodiments include multiple, substantially concentric chamfers at different angles in a stepwise fashion around the insert.

In yet another embodiment, the insert has chamfers and associated flats on multiple, circumferential sections of the insert.

In a further embodiment, an interface edge between the flat and the chamfer may be radiused.

In a still further embodiment, the flat may extend to the cutting face of the PDC layer and the edge therebetween may be radiused. In this embodiment, the presence of a chamfer is optional.

Embodiments of the present disclosure include an earth boring drill bit having at least one insert in accordance with the disclosure hereof. The at least one insert may be disposed on the gage of the drill bit.

BRIEF DESCRIPTION OF THE DRAWINGS

Some of the features and benefits of the present invention having been stated, others will become apparent as the description proceeds when taken in conjunction with the accompanying drawings, in which.

DETAILED DESCRIPTION

Figure 1:
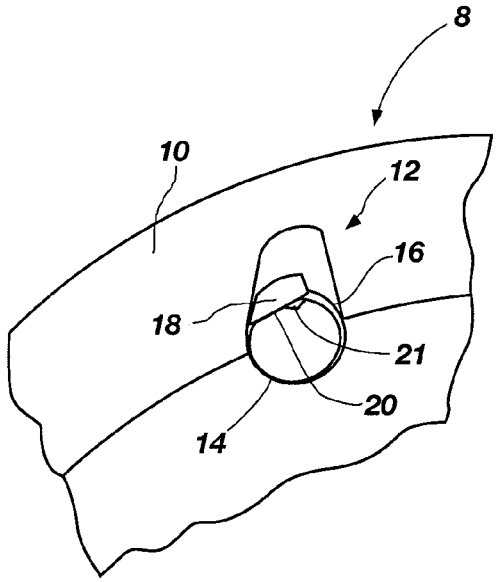
FIG. 1 (PRIOR ART)
FIG. 1 is a perspective view of a prior art insert mounted to a drag bit blade.

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout the various drawing figures.

The invention is not limited to the exact details of construction, operation, exact materials, or embodiments shown and described, as modifications and equivalents will be apparent to one skilled in the art. For example, the inserts herein described have applicability on roller cone bits as well as to fixed cutter, or so-called "drag" bits and to so-called "hybrid" bits incorporating both one or more roller cones and fixed cutting elements. Other devices that may include the inserts described herein include expandable reamers, expandable drill bits, variable gage diameter downhole tools, casing exit drill bits, and mills. Any and all such rotary downhole apparatus are encompassed herein by the term "drill bit." In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims and their legal equivalents.

Figure 2A:
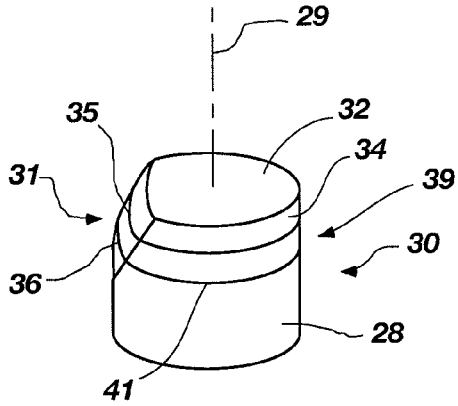
FIG. 2*a* is a side perspective view of an insert having a flattened portion and a chamfered portion according to an embodiment of the disclosure.

A perspective view of an embodiment of a cutting element 30 in accordance with the present invention is shown in FIG. 2*a*. In this embodiment, the cutting element 30 comprising a substrate in the form of base 28 (which may be formed from cemented tungsten carbide), a front or leading portion 31, and a PDC layer 39 on the upper (as the drawing figure is oriented) end of the base 28. Line 41 represents an interface where the PDC layer 39 is affixed onto the base 28. The front portion 31 includes the side of the cutting element 30 that first contacts, and encroaches into the virgin rock as a drill bit on which cutting element 30 is mounted is rotated. The front portion, as cutting element is installed on a drill bit, would be oriented outwardly from the drill bit surface, in a manner similar to the orientation shown for flat 18 in FIG. 1. Formed onto the cutting element 30 is a flat 36 and a chamfer 34; where the flat 36 is disposed on the front portion 31 of the cutting element 30 and extends from the base 28 up into the PDC layer 39. The chamfer 34 is disposed between the flat 36 and the cutting face 32 on PDC layer 39, thereby smoothing the angular transition between the flat 36 and the cutting face 32. This smooth angular transition provided by the chamfer 34 to the cutting element 30 eliminates a sharp edge formed at the upper end of the flat, as would be present in a conventional gage cutter where the upper end of the flat intersects the cutting face of the PDC layer 14 (see FIG. 1). Removing the sharp edge, in turn, reduces stress concentrations on the PDC layer 39 of cutting element 30 which increases its yield strength and potentially increases its useful life.

The border between the chamfer 34 and the flat 36 forms an interface line 35 extending along a portion of the lateral side of the PDC layer 39 below cutting face 32. In the embodiment shown, the interface line 35 is curved, having a radius extending substantially perpendicular to the insert axis 29. This configuration is unlike the linear edge of prior art inserts. As such, use of the cutting element 30 of FIG. 2*a* provides a cutting element suitable for use as a gage cutter and having lower stress concentration and, therefore, a reduced chance of damage along this front portion 31.

Higher cutter back rakes produce a more durable cutter edge in combination with a relatively passive cutting action on the borehole wall. Cutters can be set at high back rakes, but performance generally suffers as they cannot then be set flush with the rotationally leading edge of the blade. The present invention, with a large leading edge chamfer, effectively provides a high back rake angle on the PDC layer at the contact point between the radially outer gage cutter edge and the borehole wall, without the use of a high cutter back rake, providing the ability to keep the cutting face 32 of the PDC layer 39 essentially flush with the rotational blade front.

Figure 2B:
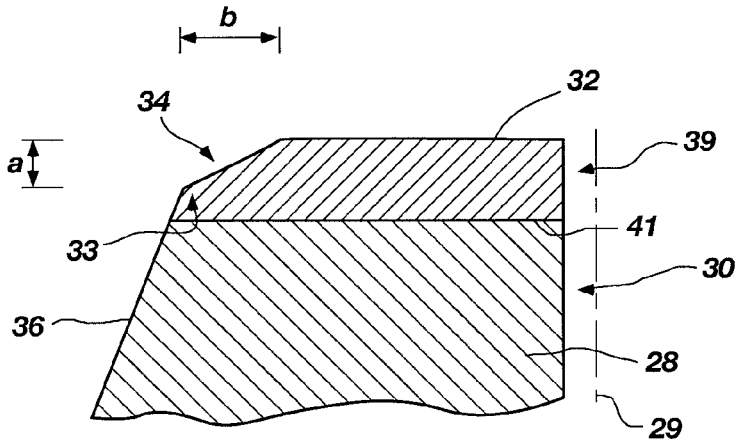
FIG. 2*b* is a cross-sectional view of the insert of FIG. 2*a;*

A cross-sectional view of the cutting element 30 is provided in FIG. 2*b*. Here, it can be seen that the chamfer 34 has an elongated configuration providing substantial surface area for reduction of interface stresses when contacting a subterranean formation. The chamfer height (line "a"), measuring parallel to the cutting element axis 29 and the chamfer length (line "b"), measured radially, are illustrated. In this embodiment, the chamfer dimensions are such that the length (line "b") of chamfer 34 exceeds the height (line "a") or depth of the chamfer 34. As such, the included angle between the chamfer 34 and the cutting face 32 of the cutting element 30 is a resulting low stress obtuse angle that exceeds 90°. The included obtuse angle 33 formed between the respective, adjacent surfaces of the chamfer 34 and the flat 36 also reduces stress concentrations on the cutting element 30 during use.

Figure 2C:
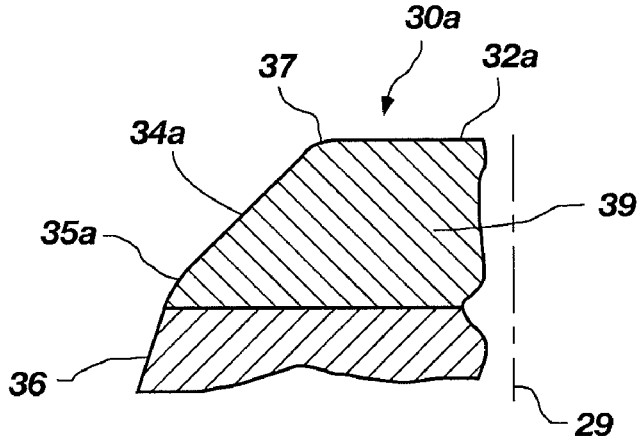
FIG. 2*c* is a cross-sectional view of another embodiment of an insert.

FIG. 2*c* illustrates a cross-sectional view of another embodiment of the cutting element 30*a*. In this embodiment the interface 35*a*, when viewed from the side, is not formed at an angle between chamfer 34*a* and flat 36 but, instead, has a curved shape whose radius extends substantially parallel to the insert axis 29. Also shown in FIG. 2*c* is an edge 37 defining the boundary between the chamfer 34*a* and the cutting face 32*a*, such boundary being the inner edge of the chamfer envelope. The edge 37 has a curved profile with a radius parallel to the insert axis 29. Providing a radiused profile to the edge 37 distributes stress more widely on the surface of the PDC layer 39 of the cutting element 30*a* during contact with formation material, increasing yield strength of the cutting element 30*a* and extending the useful effective life of the cutting element 30*a*. Radiusing the interface edge and/or the inner boundary of the chamfer envelope is not limited to the embodiment of FIG. 2*c*, but can be applied to any ridge or point on the surface of a PDC layer of a cutting element.

Figure 2D:
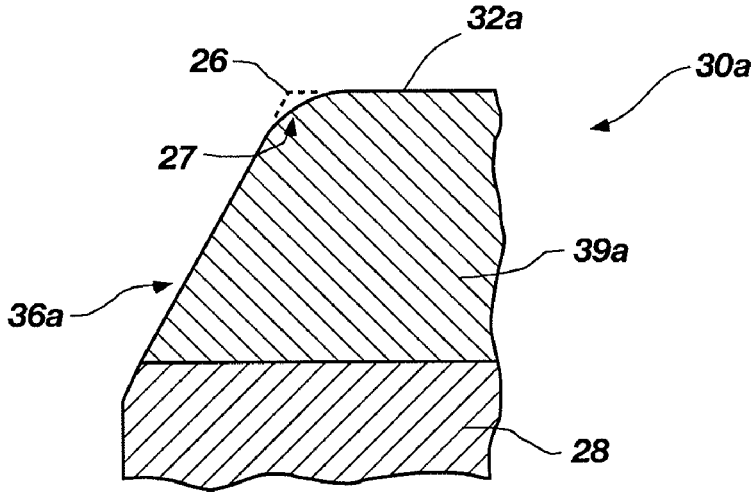
FIG. 2*d* is a cross-sectional view of an embodiment of an insert with a flat having radiused edges.

FIG. 2*d* is a cross-sectional view of another embodiment of the cutting element 30*a*. The cutting element 30*a* of FIG. 2*d* comprises a PDC layer 39*a* with a cutting face 32*a*, where the PDC layer 39*a* is attached to a carbide base 28. A flat 36*a* is shown formed on the leading edge of the cutting element 30*a* extending from the base 28 up to the cutting face 32*a*. As shown, edge material 26 that forms the interface between the flat 36*a* and the cutting face 32*a* is shown in broken lines. Removing the edge material 26 results in a radiused edge 27 along the line where the flat 36*a* meets the cutting face 32*a*. Providing a radiused edge 27 reduces localized stress concentrations in the PDC layer 39*a* during drilling operations. In this embodiment, the presence of a chamfer is optional, but may be included circumferentially outside of the flat 36*a* to minimize any potential for chipping of the PDC layer 39*a* as the cutting element 30*a* is installed in a drill bit.

Figure 3:
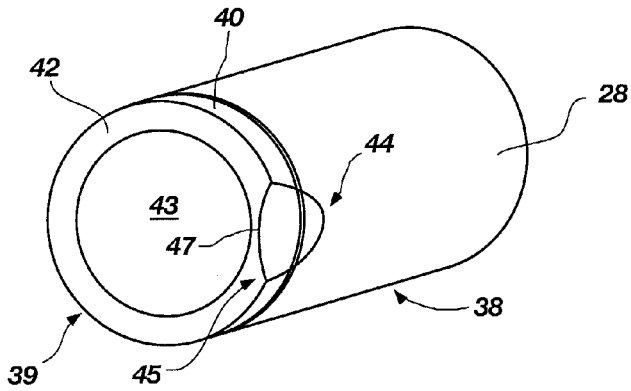
FIG. 3 is a perspective view of an embodiment of an insert having a radial chamfer with a flattened section.

A side perspective view of still another embodiment of a cutting element 38 in accordance with the present disclosure is shown in FIG. 3. In this embodiment, the PDC layer 39 includes a chamfer 42 along its entire radius, on the circumferential edge. A flat 44 is shown formed along a portion of the circumference of the cutting element 38. The chamfer 42 has a sufficient radial length such that a chamfered portion is present even after the addition of the flat 44. The boundary between the chamfer 42 and the upper terminal edge of the flat 44 defines an edge 47. Adding the chamfer 42 between the cutting face 43 and the upper edge of the flat 44, similar to the embodiments of FIGS. 2*a*-2*c*, minimizes localized stress concentrations on the leading edge of the cutting element 38. As shown in FIG. 3, the edge 47 has a curved profile. A hyperbola is one example of a suitable curved profile, but the leading edge may take on any type of curved shape. Profiling the leading edge to have a curved shape lowers stress concentrations on the cutter and produces a more efficient cutting action than a straight edge. A profile 45 is illustrated at a point on the circumferential periphery of the flat 44 adjacent the intersection of the chamfer 42 with the side 40 of the PDC layer 39, where the profile 45 is a localized peak-like portion on the periphery of the PDC layer 39 of the cutting element 38. Optionally, the profile 45 may be removed with a cutting or grinding tool, or another chamfer or a small radiused edge may be formed there to smooth the region.

Figure 4:
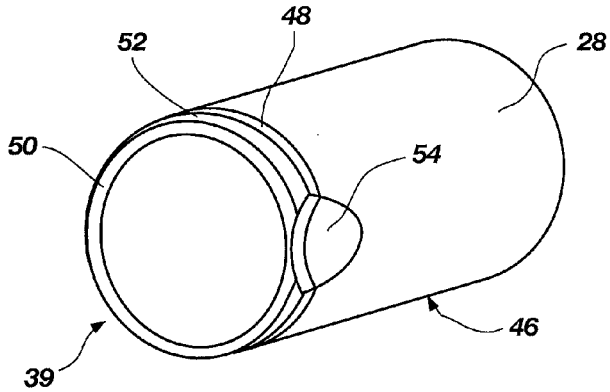
FIG. 4 is a perspective view of an insert having multiple chamfered sections and a flattened section.

FIG. 4 provides a side perspective view of an embodiment of a cutting element 46 in accordance with the present disclosure. In this embodiment, the periphery of PDC layer 39 is provided with more than one chamfer at its periphery 48. More specifically, a first chamfer 50 extends around the upper circumference of the PDC layer 39 of cutting element 46 at a first radius. The first chamfer 50 is circumscribed by a second chamfer 52 along its outer radius. Also shown is a flat 54 formed along a portion of the PDC layer 39 at its outer periphery 48 and into base 28. The use of multiple chamfers 50, 52 provides a step wise function and method for reducing the sharp angles that may occur between a flat and the cutting face of a PDC layer.

As with the embodiments of FIGS. 2*a*-2*c*, the cutting element embodiments of FIGS. 3 and 4 may have the chamfers formed before the cutting element is added to the drill bit body. Likewise, the corresponding flats may be formed before of after addition of the cutting element to the drill bit body. The interface lines that define the boundaries between the first chamfer 50 and the flat 54, and the first and second chamfers (50, 52) are curved. These curved lines provide a feature that is especially is useful for reducing localized stress concentrations, especially for casing exit tools that cut steel as the bit drills through casing components before drilling into subterranean formation material.

Figure 5:
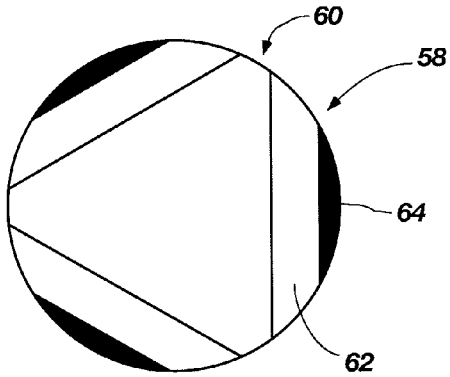
FIG. 5 is an overhead view of an insert having multiple flat sections and multiple chamfered sections.

An overhead view of yet another embodiment of a cutting element 58 is provided in FIG. 5. In this embodiment, the PDC cutting surface 60 has provided on it multiple, circumferentially spaced chamfers 62 wherein each chamfer section has a corresponding flat 64 at a lesser angle to the cutting element axis, as depicted with respect to previous embodiments, than its associated chamfer 62. One of the advantages of the multiple, circumferentially spaced chamfers with associated flats is that during the life of a drill bit equipped with a cutting element 58, the cutting element 58 can be removed, rotated, and then resecured in the cutter pocket to be reused with a fresh flat 64 and associated chamfer 62.

In one method of forming the cutting elements described herein, the circumferential chamfer or chamfer section is formed on the cutting element prior to it being added to an associated earth boring drill bit. It should be pointed out that the chamfer dimensions should take into account the expected dimensions of a flat, such that a chamfer is still present radially inwardly of the laterally inner edge of the flat after the formation of a flat on the PDC layer. After attaching the cutting element with its appropriately sized chamfer to an earth boring drill bit, the bit may be placed in a lathe and a grinding device may be used on the cutting element to form the appropriate flat. Thus, in some embodiments the chamfer angle is greater than 45° with respect to a line running parallel to the front or leading portion of the cutting element as indicated in FIG. 2*a* and thus to the axis of the cutting element. In one optional embodiment, the chamfer and the flat may have a smooth, polished finish to enhance wear resistance capabilities. In one embodiment, the angle between the chamfer and a line parallel to the front portion and to the axis of the cutting element may be 60° or more. Additionally, when material is removed from the cutting element to form the flat, the resulting chamfer width inwardly of the flat after flat formation would be desirably at least 1 millimeter. Thus, during drilling, a gage cutter configured in such a manner will present the angled chamfer surface to the formation being drilled at the gage of the drill bit, rather than a sharp edge as is presented with conventionally configured gage cutters. As a consequence, in embodiments of the present invention the PDC layer at the area of contact with the formation is placed beneficially in compression.

While the invention has been described in connection with certain embodiments, it will be understood that it is not limited to those embodiments. On the contrary, the invention encompasses all alternatives, modifications, and equivalents, as may be included within the scope of the invention as defined by the appended claims and their legal equivalents.

What is claimed is:

1. A cutting element for earth boring, the cutting element comprising:

a base having a PDC layer on an end thereof;

an axis;

at least one arcuate chamfer configured as a generally frustoconical surface extending around a circumference of the PDC layer; and at least one flat on a finite portion of the circumference of the PDC layer intersecting the at least one arcuate chamfer, the at least one flat oriented at a lesser angle to the axis than an angle of the at least one chamfer thereto and terminating at a leading edge, the leading edge proximate to a cutting face of the PDC layer and spaced from the cutting face of the PDC layer by a portion of the at least one arcuate chamfer.

2. The cutting element of claim 1, wherein the leading edge comprises a curved edge having a shape of a hyperbola.

3. The cutting element of claim 1, wherein the at least one chamfer is present on an entire circumference of the PDC layer.

4. The cutting element of claim 1, wherein the at least one chamfer comprises a plurality of chamfers on the circumference of the PDC layer.

5. The cutting element of claim 4, wherein the at least one flat comprises a plurality of circumferentially spaced flats.

6. The cutting element of claim 4, wherein the plurality of chamfers are mutually radially adjacent and the leading edge terminates within one of the chamfers of the plurality of chamfers.

7. The cutting element of claim 1, wherein at least one of an intersection between a chamfer and the cutting face, and the leading edge, comprises a radiused edge.

8. The cutting element of claim 1, wherein the at least one flat extends into the base.

9. The cutting element of claim 1, wherein the leading edge of the at least one flat extends within the at least one chamfer.

10. The cutting element of claim 9, wherein the leading edge of the at least one flat is spaced a distance of at least one millimeter from the cutting face by the portion of the at least one chamfer.

11. The cutting element of claim 1, wherein the at least one chamfer comprises a plurality of radially adjacent chamfers, and the leading edge of the at least one flat terminates longitudinally within an innermost chamfer of the plurality of chamfers.

12. The cutting element of claim 1, wherein the at least one chamfer is disposed at an angle of at least about 60° to the axis of the cutting element.

13. The cutting element of claim 1, wherein a length of the at least one chamfer exceeds a height of the at least one chamfer.

14. An earth boring drill bit, comprising:

a bit body; and at least one cutting element mounted directly to the bit body proximate a gage thereof, the at least one cutting element comprising:

a base having a PDC layer on an end thereof;

an axis;

at least one arcuate chamfer configured as a generally frustoconical surface extending around a circumference of the PDC layer; and at least one flat on a finite portion of the circumference of the PDC layer intersecting the at least one arcuate chamfer, the at least one flat oriented at a lesser angle to the axis than an angle of the at least one chamfer thereto and terminating at a leading edge, the leading edge proximate to a cutting face of the PDC layer and spaced from the cutting face of the PDC layer by a portion of the at least one arcuate chamfer.

15. The earth boring drill bit of claim 14, wherein the leading edge of the at least one flat extends within the at least one chamfer.

16. The earth boring drill bit of claim 15, wherein the leading edge of the at least one flat is spaced a distance of at least one millimeter from the cutting face by the portion of the at least one chamfer.

17. The earth boring drill bit of claim 15, wherein the at least one chamfer is disposed at an angle of at least about 60° to the axis of the at least one cutting element.

* * * * *

UNITED STATES PATENT AND TRADEMARK OFFICE

CERTIFICATE OF CORRECTION

PATENT NO. : 8,061,456 B2
APPLICATION NO. : 12/198246
DATED : November 22, 2011
INVENTOR(S) : Suresh G. Patel, Danny E. Scott and L. Allen Sinor It is certified that error appears in the above-identified patent and that said Letters Patent is hereby corrected as shown below:

On the title page:

| | |
|---|---|
| In ITEM (54) and in the Specification, Column 1, Lines 1-2, | change "**CUTTERS AND DRILL BITS SO EQUIPPED**" to --**CUTTERS, DRILL BITS SO EQUIPPED, AND METHODS OF CUTTER MANUFACTURE**-- |
| In ITEM (57) **ABSTRACT:** | change "bit, may" to --bit may-- |

Signed and Sealed this
Fourteenth Day of July, 2015

Michelle K. Lee

Michelle K. Lee
*Director of the United States Patent and Trademark Office*